US009181778B2

(12) United States Patent
Hurtado et al.

(10) Patent No.: US 9,181,778 B2
(45) Date of Patent: Nov. 10, 2015

(54) MULTIPLE BALL-BALL SEAT FOR HYDRAULIC FRACTURING WITH REDUCED PUMPING PRESSURE

(75) Inventors: Jose Hurtado, Houston, TX (US); John C. Wolf, Houston, TX (US)

(73) Assignee: Smith International, Inc., Houston, TX (US)

( * ) Notice: Subject to any disclaimer, the term of this patent is extended or adjusted under 35 U.S.C. 154(b) by 340 days.

(21) Appl. No.: 13/174,860

(22) Filed: Jul. 1, 2011

(65) Prior Publication Data

US 2012/0061103 A1 Mar. 15, 2012

Related U.S. Application Data

(63) Continuation-in-part of application No. 13/091,988, filed on Apr. 21, 2011.

(60) Provisional application No. 61/327,509, filed on Apr. 23, 2010, provisional application No. 61/360,796, filed on Jul. 1, 2010.

(51) Int. Cl.

| | |
|---|---|
| ***E21B 34/00*** | (2006.01) |
| ***E21B 34/14*** | (2006.01) |
| ***E21B 34/10*** | (2006.01) |

(52) U.S. Cl.

CPC ..... *E21B 34/14* (2013.01); *E21B 34/00* (2013.01); *E21B 34/103* (2013.01); *E21B 2034/002* (2013.01); *E21B 2034/007* (2013.01)

(58) Field of Classification Search

CPC ... E21B 33/12; E21B 34/06; E21B 2034/002; E21B 34/10; E21B 34/14; E21B 34/00; E21B 2034/007; E21B 34/13

USPC ..... 166/386, 318, 332.3, 308.1, 373

See application file for complete search history.

(56) References Cited

U.S. PATENT DOCUMENTS

| | | | |
|---|---|---|---|
| 7,503,392 | B2 | 3/2009 | King et al. |
| 7,637,323 | B2 | 12/2009 | Schasteen et al. |

(Continued)

FOREIGN PATENT DOCUMENTS

| | | | |
|---|---|---|---|
| AU | 2006257625 | A1 | 12/2006 |
| CN | 2898283 | Y | 5/2001 |

(Continued)

OTHER PUBLICATIONS

International Search Report and Written Opinion of the International Search Authority dated Jan. 16, 2012 mailed in the corresponding PCT application PCT/US2011/042739, filed on Jul. 1, 2011.

(Continued)

*Primary Examiner* — Yong-Suk (Philip) Ro

(74) *Attorney, Agent, or Firm* — Jeffery R. Peterson; Brandon S. Clark

(57) ABSTRACT

A downhole isolation tool including a sub, a sleeve disposed in the sub, and a ball seat mandrel coupled to the sleeve, the ball seat mandrel having at least two ball seats axially aligned with at least two throughbores disposed within the ball seat mandrel. A method of isolating a well, the method including running a downhole isolation system into a well, wherein the downhole isolation system includes a first downhole isolation tool, the first downhole isolation tool including a first sub, a first sleeve disposed in the sub, and a first ball seat mandrel coupled to the first sleeve, the first ball seat mandrel having at least two ball seats of a first size axially aligned with at least two throughbores disposed within the first ball seat mandrel, dropping at least two balls of a first size into the well, and seating the at least two balls of the first size in the at least two ball seats of the first ball seat mandrel.

19 Claims, 10 Drawing Sheets

(56) References Cited

U.S. PATENT DOCUMENTS

| | | | | |
|---|---|---|---|---|
| 7,644,772 | B2 | 1/2010 | Avant et al. | |
| 7,647,964 | B2 | 1/2010 | Akbar et al. | |
| 7,735,549 | B1 | 6/2010 | Nish et al. | |
| 2003/0127227 | A1 | 7/2003 | Fehr et al. | |
| 2007/0062706 | A1 | 3/2007 | Leising | |
| 2007/0074873 | A1 | 4/2007 | McKeachnie et al. | |
| 2007/0261855 | A1 | 11/2007 | Brunet | |
| 2009/0044946 | A1 | 2/2009 | Schasteen et al. | |
| 2009/0308614 | A1 | 12/2009 | Sanchez et al. | |
| 2010/0051291 | A1 | 3/2010 | Marcu | |
| 2010/0314126 | A1* | 12/2010 | Kellner | 166/373 |
| 2011/0259610 | A1 | 10/2011 | Shkurti et al. | |
| 2011/0278017 | A1* | 11/2011 | Themig et al. | 166/373 |

FOREIGN PATENT DOCUMENTS

| | | | |
|---|---|---|---|
| NO | 932730 | A | 2/1994 |
| RU | 62155 | U1 | 3/2007 |
| RU | 2323321 | C1 | 4/2008 |
| WO | 9803766 | A1 | 1/1998 |
| WO | 2006134446 | A2 | 12/2006 |

OTHER PUBLICATIONS

Chinese Office Action for Application No. 201180041626.1 dated Oct. 24, 2014.

* cited by examiner

MULTIPLE BALL-BALL SEAT FOR HYDRAULIC FRACTURING WITH REDUCED PUMPING PRESSURE

CROSS-REFERENCE TO RELATED APPLICATION

This application claims priority to and is a Continuation in Part of U.S. patent application Ser. No. 13/091,988, filed on Apr. 21, 2011, which in turn is entitled to the benefit of, and claims priority to U.S. Provisional Patent Application Ser. No. 61/327,509, filed on Apr. 23, 2010, the entire disclosures of each of which are incorporated herein by reference. This application also claims priority under 35 U.S.C. §119(e) to U.S. Provisional Application Ser. No. 61/360,796, filed on Jul. 1, 2010, which is incorporated herein by reference.

BACKGROUND OF INVENTION

1. Field of the Invention

Embodiments disclosed herein generally relate to a downhole isolation tool. More specifically, embodiments disclosed herein relate to a downhole isolation tool having a ball seat mandrel having two or more ball seats. Additionally, embodiments disclosed herein relate to a downhole isolation system having two or more downhole isolation tools. Further, embodiments disclosed herein relate to methods of running a downhole isolation system into a well and isolating zones of a well with a downhole isolation system.

2. Background Art

In drilling, completing, or reworking wells, it often becomes necessary to isolate particular zones within the well. In some applications, downhole isolation tools are lowered into a well to isolate a portion of the well from another portion. The downhole tool typically includes a sleeve coupled to a ball seat. A ball may be dropped from the surface and seated in the ball seat to seal or isolate a portion of the well below the tool from a portion of the well above the tool. More than one downhole isolation tool may be run into the well, such that multiple zones of the well are isolated.

The downhole isolation tool may be run in conjunction with other downhole tools, including, for example, packers, frac (or fracturing) plugs, bridge plugs, etc. The downhole isolation tool and other downhole tools may be removed by drilling through the tool and circulating fluid to the surface to remove the drilled debris.

The downhole isolation tool may be set by wireline, coil tubing, or a conventional drill string. The tool may be run in open holes, cased holes, or other downhole completion systems. The ball seat disposed in the downhole isolation tool is configured to receive a ball to isolate zones of a wellbore and allow production of fluids from zones below the downhole isolation tool. The ball is seated in the seat when a pressure differential is applied across the seat from above. For example, as fluids are pumped from the surface downhole into a formation to fracture the formation, the ball is seated in a ball seat to maintain the fluid, and therefore, provide fracturing of the formation in the zone above the downhole isolation tool. In other words, the seated ball may prevent fluid from flowing into the zone isolated below the downhole isolation tool. Fracturing of the formation allows enhanced flow of formation fluids into the wellbore. The ball may be dropped from the surface or may be disposed inside the downhole isolation tool and run downhole within the tool.

At high temperatures and pressures, i.e., above approximately 300° F. and above approximately 10,000 psi, the commonly available materials for downhole balls may not be reliable. Furthermore, as shown in FIGS. 1A and 1B, a conventional ball seat 36 includes a tapered or funnel seating surface 40. The ball 38 makes contact with the seating surface 40 and forms an initial seal. Based on the geometries of the seating surface 40 and ball 38, there is a large radial distance between the inside diameter of the seating surface 40 and the outside diameter of the ball 38. Thus, the bearing area between the seating surface 40 and the ball 38 is small. As the ball 38 is loaded to successively higher loads, the ball 38 may be subjected to high compressive loads that exceed its material property limits, thereby causing the ball 38 to fail. Even if the ball 38 deforms, the ball 38 cannot deform enough to contact the tapered seating surface 40, and therefore the bearing surface 40 of the ball seat 36 for the ball 38 remains small. An increase in ambient temperature can also increase the likelihood of extruding the ball 38 through the seat 36 due to decreased properties of the material. The mechanical properties of the ball 38 material may decrease, e.g., compressive stress limits and elasticity, which can lead to an increased likelihood of the ball cracking or extruding through the ball seat 36. Thus, in high temperature and high pressure environments, conventional downhole isolation tool, i.e., balls 38 and ball seats 36 within the downhole isolation tool, may leak or fail.

In open hole fracturing systems that use such balls and ball drop devices as means to isolate distinct zones for hydraulic fracturing treatment, different sized balls are used for each isolation zone. Specifically, in a wellbore where multiple zones are isolated, a series of balls are used to isolate each zone. A ball of a first size seals a first seat in a first zone and a ball of a second size seals a second seat in a second zone. The lowermost zone uses the smallest ball of the series of balls and the uppermost zone uses the largest ball of the series of balls. The smallest sized ball is typically ¾ inch to 1 inch in diameter. The corresponding ball seat and corresponding throughbore must have a diameter smaller than the ball to receive and support the ball. Typical hydraulic fracturing fluid rates are between 20 BPM (barrels per minute) and 40 BPM. The pressure drop through a restriction, i.e., the ball seat and corresponding axial throughbore, as small as ¾ inch is substantial. Such a pressure drop increases the total pump horsepower needed on location to complete an isolation job.

Accordingly, there exists a need for a downhole isolation tool that effectively seals or isolates the zones above and below the plug in high temperature and high pressure environments and provides sufficient through flow through the system.

SUMMARY OF INVENTION

In one aspect, embodiments disclosed herein relate to a downhole isolation tool including a sub, a sleeve disposed in the sub, and a ball seat mandrel coupled to the sleeve, the ball seat mandrel having at least two ball seats axially aligned with at least two throughbores disposed within the ball seat mandrel.

In another aspect, embodiments disclosed herein relate to a downhole isolation system, the system including a first downhole isolation tool including a first sub, a first sleeve disposed in the first sub, and a first ball seat mandrel coupled to the first sleeve, the first ball seat mandrel having at least two ball seats axially aligned with at least two throughbores disposed within the first ball seat mandrel, and a second downhole isolation tool including a second sub, a second sleeve disposed in the second sub, and a second ball seat mandrel coupled to the second sleeve, the second ball seat mandrel having at least two ball seats axially aligned with at least two throughbores disposed within the second ball seat mandrel.

In yet another aspect, embodiments disclosed herein relate to a method of isolating a well, the method including running a downhole isolation system into a well, wherein the downhole isolation system includes a first downhole isolation tool, the first downhole isolation tool including a first sub, a first sleeve disposed in the sub, and a first ball seat mandrel coupled to the first sleeve, the first ball seat mandrel having at least two ball seats of a first size axially aligned with at least two throughbores disposed within the first ball seat mandrel, dropping at least two balls of a first size into the well, and seating the at least two balls of the first size in the at least two ball seats of the first ball seat mandrel.

Other aspects and advantages of the invention will be apparent from the following description and the appended claims.

DETAILED DESCRIPTION

Embodiments disclosed herein generally relate to a downhole isolation tool. More specifically, embodiments disclosed herein relate to a downhole isolation tool having a ball seat mandrel having two or more ball seats. Additionally, embodiments disclosed herein relate to a downhole isolation system having two or more downhole isolation tools. Further, embodiments disclosed herein relate to methods of running a downhole isolation system into a well and isolating zones of a well with a downhole isolation system.

Figure 1A:
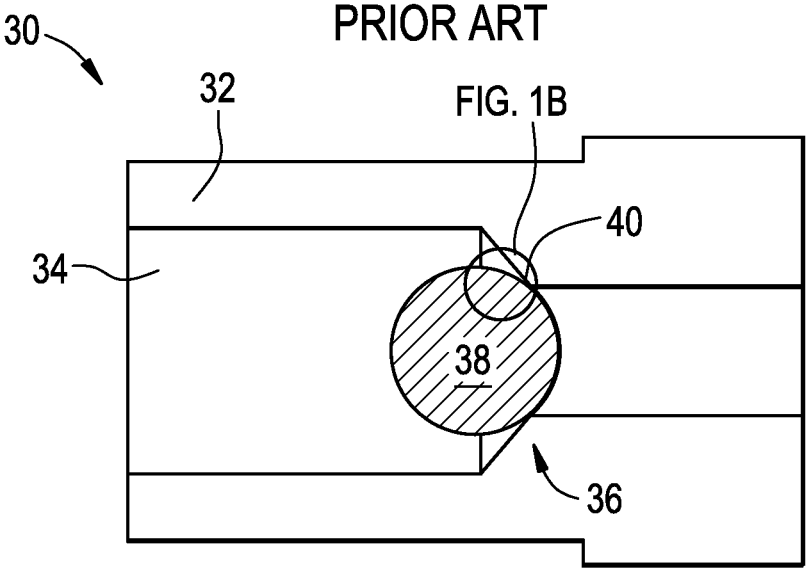
FIG. 1A PRIOR ART
FIG. 1A shows a cross-sectional view of a conventional ball seat and ball disposed in the ball seat.
Figure 1B:
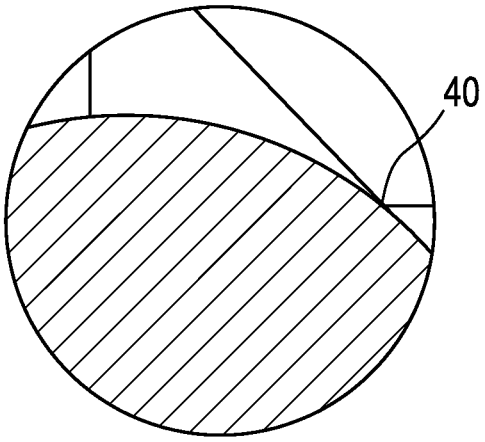
FIG. 1B is a detailed view of the conventional ball seat and ball of FIG. 1A.
Figure 2A:
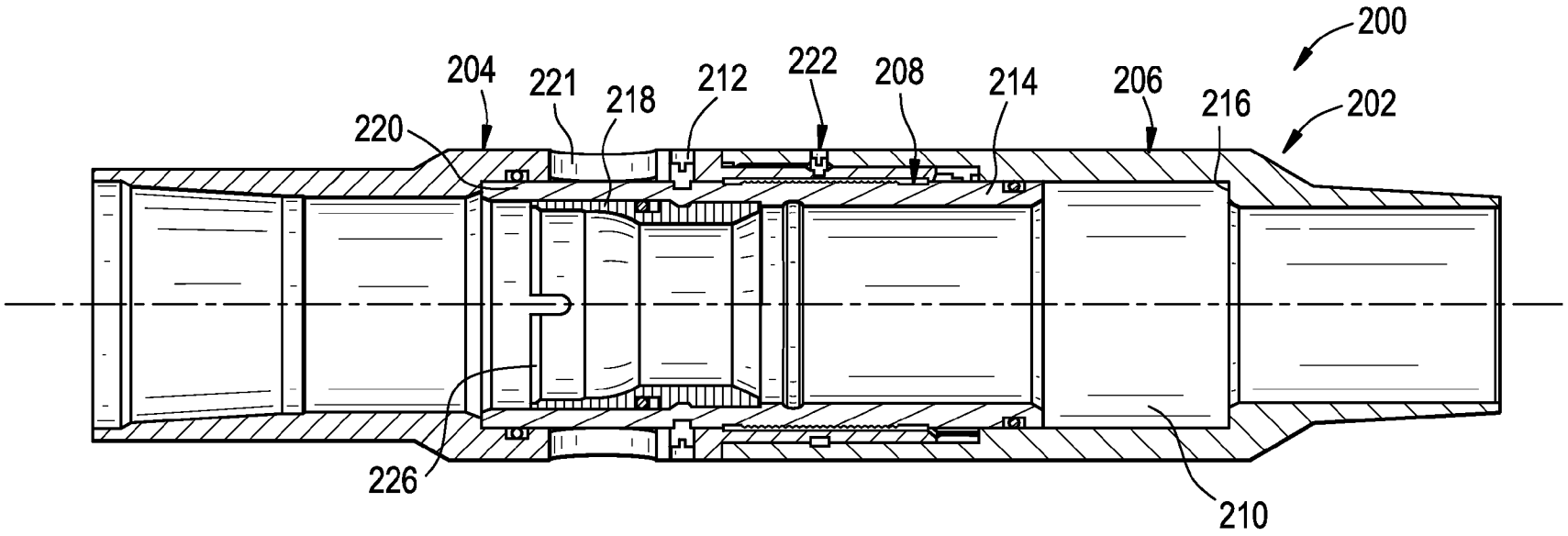
FIGS. 2A and 2B show cross-sectional views of a downhole isolation tool in accordance with embodiments disclosed herein.
Figure 2B:
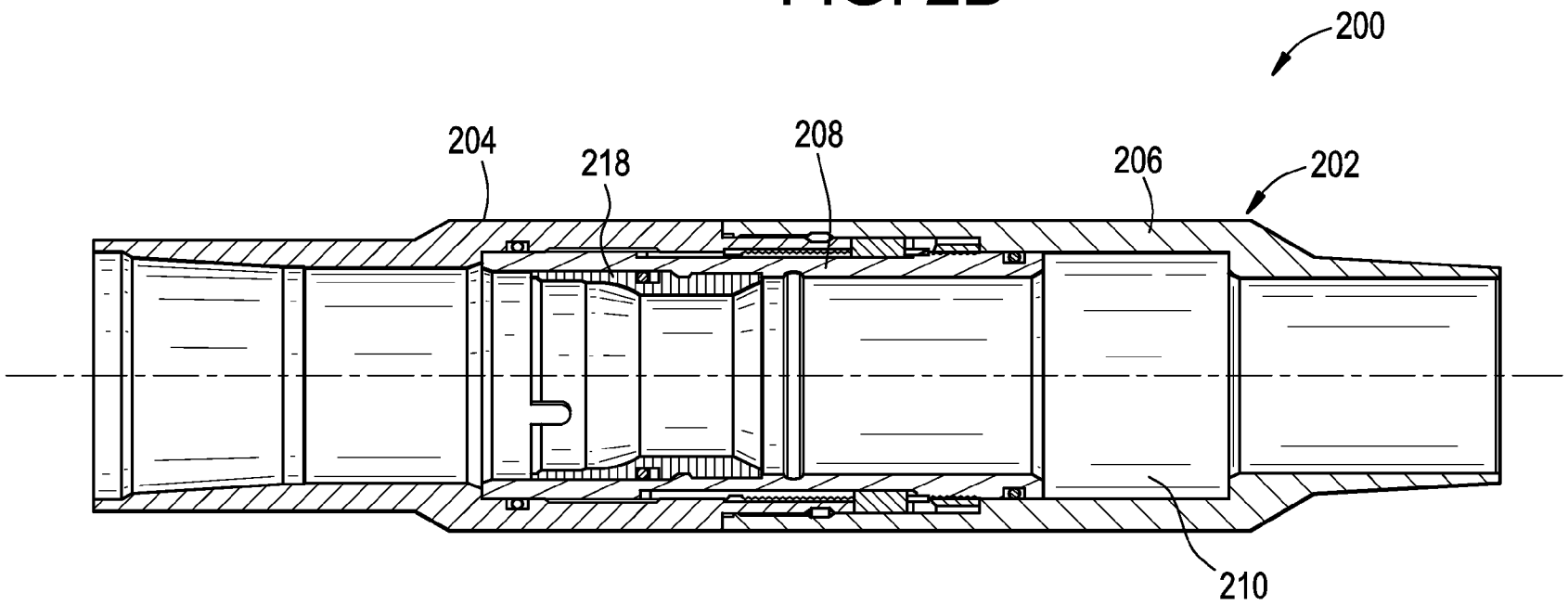

FIGS. 2A and 2B show a downhole isolation tool 200 in accordance with embodiments disclosed herein. Tool 200 includes a sub 202 that may be coupled to a drillstring, production string, coiled tubing, or other downhole components. The sub 202 may be a single tubular component or may include two or more components. For example, as shown in FIGS. 2A and 2B, sub 202 may include an upper housing 204 and a lower housing 206. The upper housing 204 and the lower housing 206 may be threadedly coupled to one another or coupled by any other means known in the art, e.g., welding, press fit, and coupling with mechanical fasteners. For example, one or more set screws 222 may couple the lower housing 206 to the upper housing 204. One or more ports 221 are disposed in the sub 202 to allow fluid communication between the bore of the sub 202 and an annular space (not shown) formed between the sub 202 and the well (not shown).

Tool 200 further includes a sleeve 208 disposed within the sub 202. The sleeve 208 is configured to slide axially downward within the sub 202 when a predetermined pressure is applied from above the tool 200, as will be described in more detail below. Sleeve 208 is initially coupled to the sub 202 proximate a first or upper end of a main cavity 210 of the sub 202. A shearing device 212 couples the sleeve 208 to an inner surface of the sub 202. In one embodiment, the shearing device 212 may include one or more shear pins or shear screws configured to retain the sleeve 208 in an initial position until a predetermined pressure is applied from above the tool 200.

Tool 200 further includes a ball seat mandrel 218 coupled to the sleeve 208. In one embodiment, the ball seat mandrel 218 may be disposed within the sleeve 208 proximate an upper end 220 of the sleeve 208. However, in other embodiments, the ball seat mandrel 218 may be disposed proximate the center or lower end 214 of the sleeve 208. The ball seat mandrel 218 may be coupled to the sleeve by any means known in the art. For example, in one embodiment, ball seat mandrel 218 may be threadedly engaged with the sleeve 208. In another embodiment, the ball seat mandrel 218 may be welded to the ball seat mandrel 218.

Figure 3A:
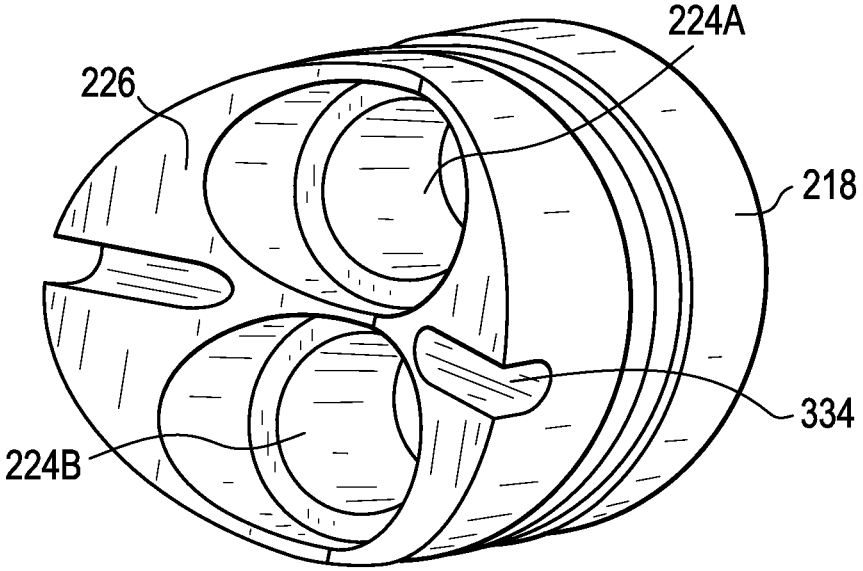
FIGS. 3A and 3B show a perspective view and a cross-sectional view, respectively, of a ball seat mandrel for a downhole isolation tool in accordance with embodiments disclosed herein.
Figure 3B:
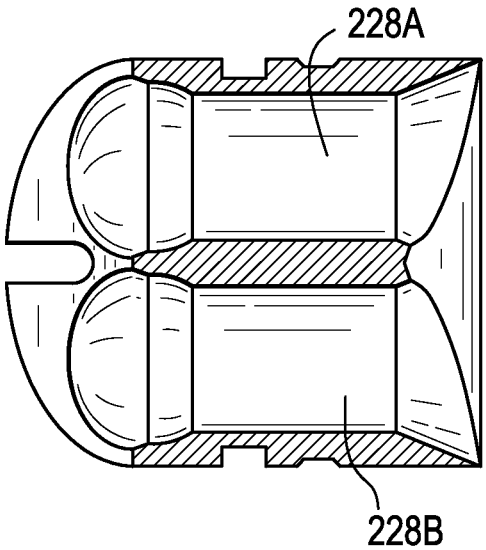

Referring now to FIGS. 3A and 3B, a perspective view and a cross-sectional view, respectively, of a ball seat mandrel 218 in accordance with embodiments disclosed herein are shown. As shown, in one embodiment, ball seat mandrel 218 may include two ball seats 224A, 224B formed in an upper face 226 of the ball seat mandrel 218. Each ball seat 224A, 224B is axially aligned with one of two throughbores 228A, 228B extending through the ball seat mandrel 218. The diameters of ball seats 224A, 224B and corresponding throughbores 228A, 228B are sized so as to maximize the fluid flow area through the ball seat mandrel 218.

The upper face 226 of the ball seat mandrel 218 is contoured so as to ensure proper seating of a dropped ball (not shown) in each of the seats 224A, 224B. Additionally, the contour of the upper face 226 may be configured to enhance the hydrodynamics of the ball seat mandrel 218, i.e., to help direct flow through the throughbores 228A, 228B, reduce friction of fluid flowing through the seats 224A, 224B and the throughbores 228A, 228B, and reduce wear of the upper face 226 and the ball seat mandrel 218 in general.

Figure 4A:
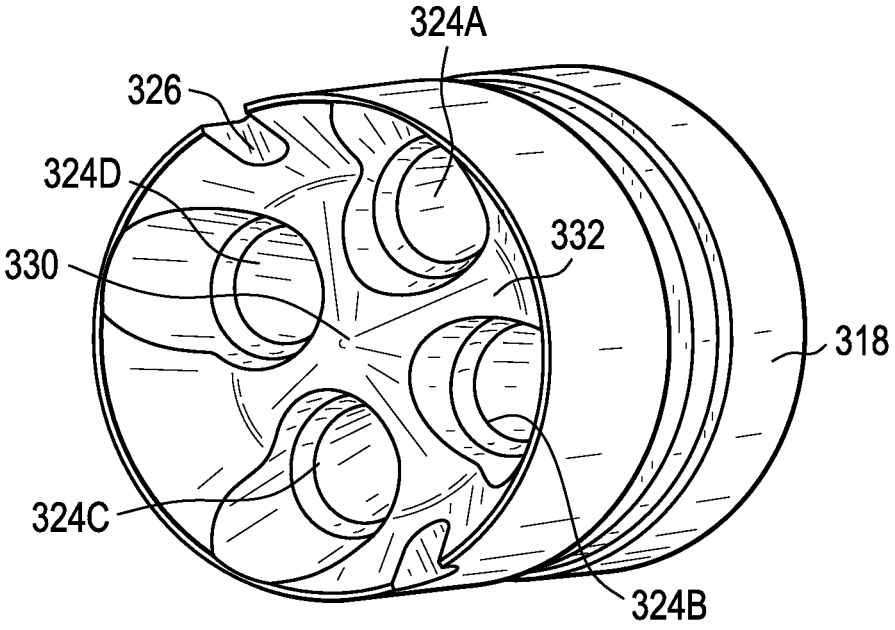
FIGS. 4A and 4B show a perspective view and a cross-sectional view, respectively, of a ball seat mandrel for a downhole isolation tool in accordance with embodiments disclosed herein.
Figure 4B:
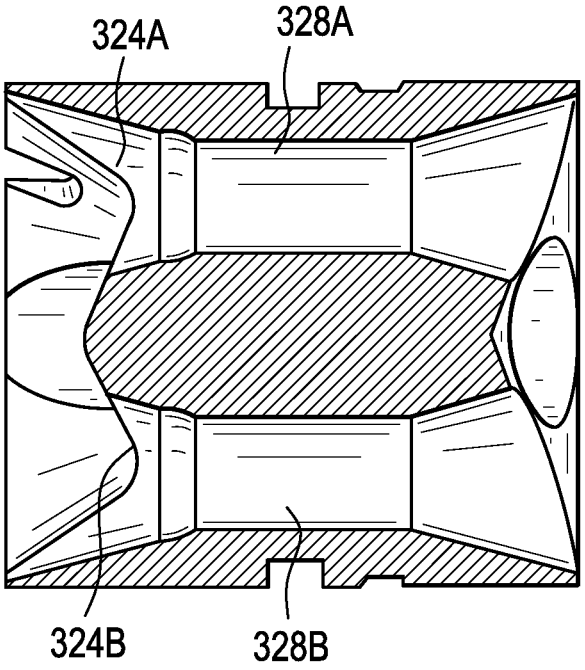

While FIGS. 3A and 3B show a ball seat mandrel 218 having two ball seats 224A, 224B and two corresponding throughbores 228A, 228B, one of ordinary skill in the art will appreciate that three, four, or more ball seats 224 may be formed in the upper face 226 of the ball seat mandrel 218. FIGS. 4A and 4B show a perspective view and a cross-sectional view, respectively, of a ball seat mandrel 318 having four ball seats 324A, 324B, 324C, 324D in accordance with embodiments of the present disclosure. As shown, each ball seat 324A, 324B, 324C, 324D is axially aligned with one of four throughbores (only two are shown in this view) 328A, 328B extending through the ball seat mandrel 318. The diameters of ball seats 324A, 324B, 324C, 324D and corresponding throughbores 328A, 328B are sized so as to maximize the fluid flow area through the ball seat mandrel 318.

The upper face 326 of the ball seat mandrel 318 is contoured so as to ensure proper seating of a dropped ball (not shown) in each of the seats 324A, 324B, 324C, 324D. Additionally, the contour of the upper face 326 may be configured to enhance the hydrodynamics of the ball seat mandrel 318, i.e., to help direct flow through the throughbores 328A, 328B, reduce friction of fluid flowing through the seats 324A, 324B, 324C, 324D and the throughbores 328A, 328B, and reduce wear of the upper face 326 and the ball seat mandrel 318 in general. For example, as shown in FIGS. 4A and 4B, the upper face 326 of the ball seat mandrel 318 may be contoured such that a central portion 330 of the upper face 326 is higher than a circumferential portion 332 proximate each of the four ball seats 324A, 324B, 324C, 324D. This elevated or raised central portion 330 of the upper face 326 prevents a ball (not shown) from settling or seating against the surface of the upper face 326 instead of seating within one of the ball seats 324A, 324B, 324C, 324D. Portions of the upper face 326 between one or more ball seats may similarly be raised so as to ensure proper seating of a ball within the ball seats 324A, 324B, 324C, 324D. As fluid flows down the well with balls (not shown) contained within the fluid flow, the contour of the upper face 326, in addition to the fluid pressure, help seat each of the balls (not shown) in each one of the ball seats 324A, 324B, 324C, 324D.

Figure 5A:
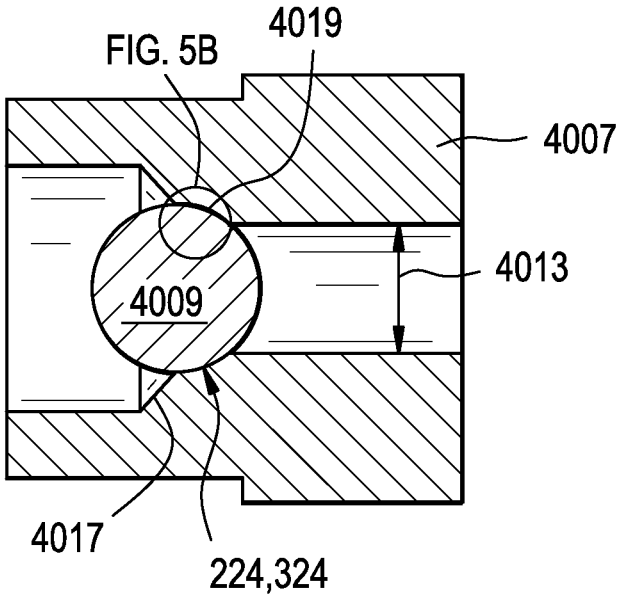
FIG. 5A shows a cross-sectional view of a ball seat in accordance with embodiments disclosed herein.
Figure 5B:
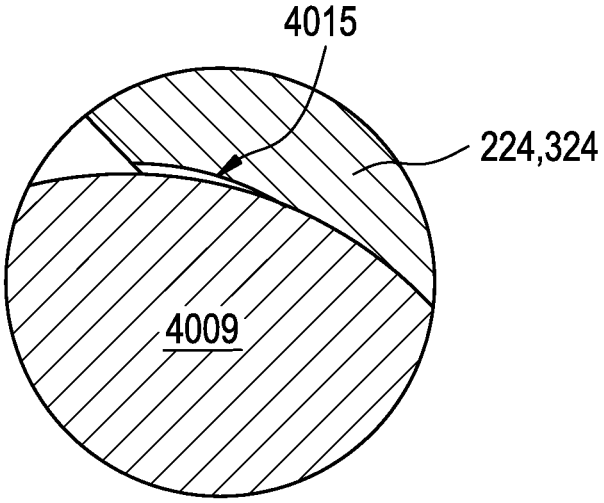
FIG. 5B shows a detailed view of FIG. 5A.

One or more ball seats 224A-B, 324A-D of the embodiments described with respect to FIGS. 3A, 3B, 4A, and 4B may include a seating surface 4015 having an arcuate profile, as shown in FIGS. 5A and 5B, and as disclosed in U.S. Application Ser. No. 61/327,509, which is hereby incorporated by reference in its entirety. As shown, the profile of the seating surface 4015 corresponds to the profile of a ball 4009 dropped into the well and seated in the ball seat 224, 324. In particular, the profile of the seating surface 4015 is curved. The arcuate profile may be spherical or elliptical. Thus, the radius of curvature of the arcuate profile may be constant or variable. The radius of curvature of the seating surface 4015 may be approximately equal to the radius of curvature of the ball 4009. Thus, in one embodiment, the seating surface 4015 provides an inverted dome-like seat with a bore therethrough configured to receive the ball 4009.

In one embodiment, the seat 224A-B, 324A-D may include a first section 4017 and a second section 4019, as shown in FIG. 5A. The first section 4017 is disposed axially above the second section 4019. In this embodiment, the first section 4017 may include a tapered profile, such that a conical surface is formed. The second section 4019 may include a profile that corresponds to the profile of the ball 4009. As the ball 4009 is dropped or as it moves downward within the downhole isolation tool when a differential pressure is applied from above the tool, the first section 4017 may help center or guide the ball 4009 into the seat and into contact with the second section 4019.

Figure 6A:
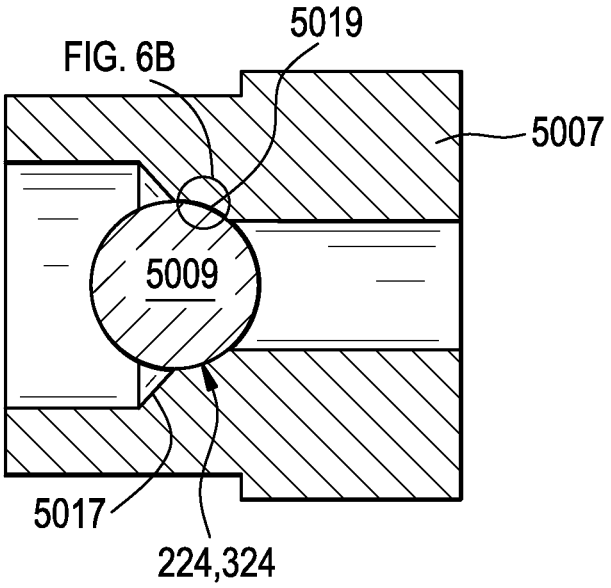
FIG. 6A shows a cross-sectional view of a ball seat in accordance with embodiments disclosed herein.
Figure 6B:
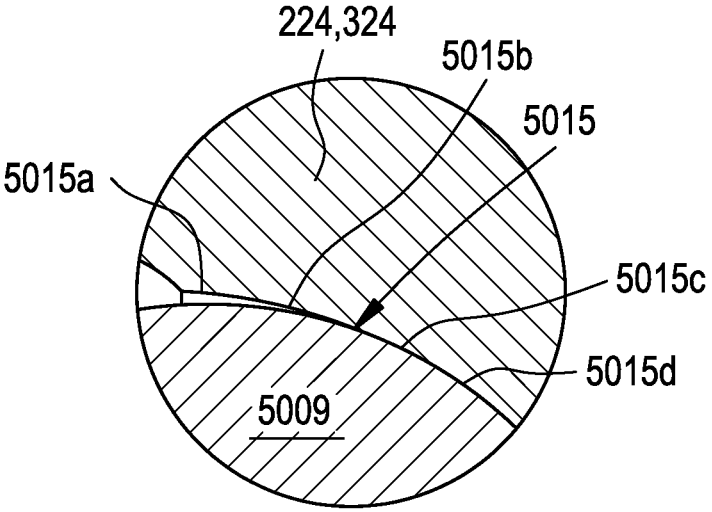
FIG. 6B shows a detailed view of FIG. 6A.

As shown in FIGS. 6A and 6B, the seat 224A-B, 324A-D of a downhole isolation tool in accordance with embodiments disclosed herein, may include a seating surface 5015 having a profile. As shown, the profile of the seating surface 5015 substantially corresponds to the profile of the ball 5009. In particular, the profile of the seating surface 5015 includes a plurality of discrete sections 5015*a*, 5015*b*, 5015*c*, 5015*d* that collectively form a continuous profile to correspond to the profile of the ball 5009. In some embodiments, the profile of the seating surface 5015 may include 2, 3, 4, 5, or more discrete sections. The discrete sections may be linear or arcuate. For example, in one embodiment, each discrete section has a radius of curvature different from each other discrete section. Alternatively, each discrete section may have the same radius of curvature, but the radius of curvature of each discrete section is smaller than the radius of curvature of the ball 5009. In another example, each discrete section may be linear and may include an angle with respect to the central axis of the mandrel 5007 or ball seat 224A-B, 324A-D different from the angle of each other discrete section. An average of the overall profile of the seating surface 5015 provides a profile that substantially corresponds to the profile of the ball 5009.

In one embodiment, the seat 224A-B, 324A-D may include a first section 5017 and a second section 5019, as shown in FIG. 6A. The first section 5017 is disposed axially above the second section 5019. In this embodiment, the first section 5017 may include a tapered profile, such that a conical surface is formed. The second section 5019 may include a profile that substantially corresponds to the profile of the ball 5009. As the ball 5009 is dropped or as it moves downward within the downhole isolation tool when a differential pressure is applied from above the tool, the first section 5017 may help center or guide the ball 5009 into the seat and into contact with the second section 5019.

Referring to FIGS. 5A-B and 6A-B, the geometry (i.e., profile) of the seat 224A-B, 324A-D provides sufficient contact between the ball 4009, 5009 and the seat 224A-B, 324A-D to effect a seal. An increasing load on the ball due to the differential pressure may deform the ball 4009, 5009 slightly into the ball seat 224A-B, 324A-D, thereby enhancing the seal. Because the radial clearance between the outside diameter of the ball 4009, 5009, and the seat 224A-B, 324A-D is small, in some embodiments, the ball 4009, 5009 may only need to deform a small amount to provide full contact with the seating surface 4015, 5015 of the ball seat 224A-B, 324A-D.

The profile of the seating surface 4015, 5015 as described above allows for a larger contact surface between the seated ball 4009, 5009, and the seating surface 4015, 5015. This contact surface provides additional bearing area for the ball 4009, 5009, thereby preventing failure of the ball material due to compressive stresses that exceed the maximum allowable compressive stress of the material. If the differential pressure is increased, the ball 4009, 5009 may deform and contact the ball seat 224A-B, 324A-D as described above for additional bearing support by the seat 224A-B, 324A-D. Due to the small radial clearance between the ball 4009, 5009 and the seating profile 4015, 5015, the deformation of the ball 4009, 5009 may be minimal.

Referring back to FIGS. 3A and 3B, ball seat mandrel 218 may also include a notch, groove, or other opening configured to be engaged with an assembly tool. Specifically, one or more notches 334 may be formed in the upper face 226 of the ball seat mandrel 218 to allow an assembly tool to engage the ball seat mandrel 218 and assemble the ball seat mandrel 218 in the sleeve 208 (FIGS. 2A and 2B). For example, in one embodiment, an assembly tool (not shown) may engage the notch 334 and be rotated to engage threads on an outer surface of the ball seat mandrel 218 and threads on an inner surface of the sleeve 208. One of ordinary skill in the art will appreciate that various assembly tools may be used and various means for coupling the ball seat mandrel 218 to the sleeve 208 may be used as known in the art.

Figure 7:
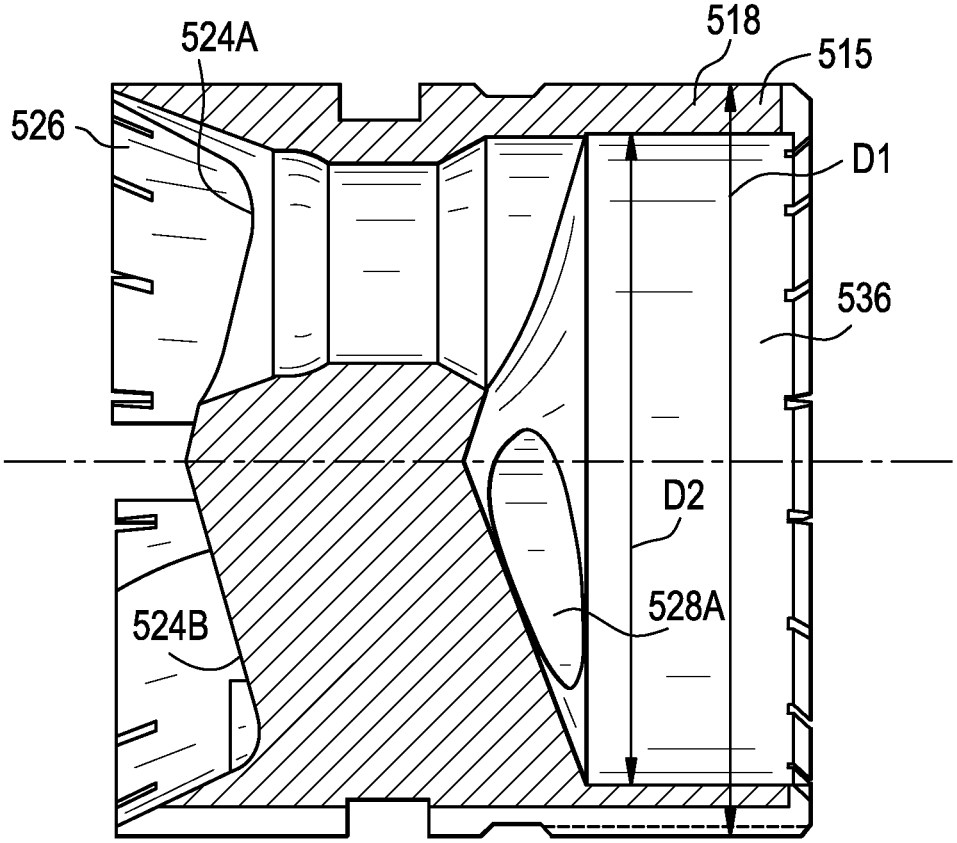
FIG. 7 shows a cross-sectional view of a ball seat mandrel for a downhole isolation tool in accordance with embodiments disclosed herein.

Referring now to FIG. 7, a cross-sectional view of a ball seat mandrel 518 is shown in accordance with embodiments disclosed herein. As shown, the ball seat mandrel 518 includes at least two ball seats 524A, 524B disposed on a contoured upper face 526. In this embodiment, a lower end 515 of the ball seat mandrel 518 includes a cavity 536. Cavity 536 is formed within the lower end 514 of the ball seat mandrel 518 so as to provide a cylindrical lower section of the ball seat mandrel 518 having an outer diameter D1 and an inner diameter D2. Thus, a ball sat mandrel 518 formed in accordance with the embodiment shown in FIG. 6 may include two or more throughbores (FIG. 6 shows one of these throughbores 528A) having an axial length less than a throughbore formed in accordance with embodiments shown in FIGS. 3 and 4. Such a cavity 536 may reduce the total volume of material to be drilled up once the fracturing treatment or other job has been completed. As such, the time it takes to remove the downhole isolation tool may be reduced.

In some wells, multiple zones may need to be isolated in a well. In such an application, multiple downhole isolation tools may be run into the well to isolate each section of the well. Specifically, a system of multiple downhole isolation tools may be run into the well so as to provide fracturing of each isolated section and to allow production of fluids from each of the zones. In one embodiment, two or more downhole isolation tools may be run into the well. Because the tools are run in series, i.e., one downhole isolation tool is disposed axially downward of a second downhole isolation tool, a series of different sized balls may be used to seat or seal within each tool. Specifically, smaller balls are used to seat against a first downhole isolation tool than the balls used to seat against a downhole isolation tool positioned axially above the first downhole isolation tool. Different sized balls are used such that the balls used to seat against the first downhole isolation tool (i.e., the lower tool) are small enough to safely pass through the downhole isolation tools disposed above the first downhole isolation tool as the balls are run within a fluid downhole to be seated. Similarly, once production of fluids from below is resumed, the balls need to be small enough to safely pass upward through downhole isolation tools positioned above the tool with the seated ball to allow the balls to be removed from the system with the production fluid.

Figure 9:
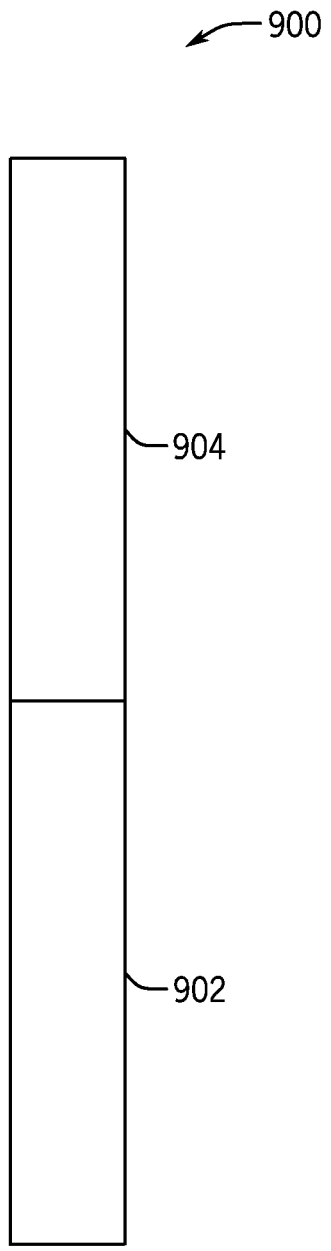
FIG. 9 is a schematic view of first and second downhole isolation tools according to example embodiments disclosed herein.

Referring to FIG. 9, accordingly, in one embodiment, a downhole isolation system 900 may include two or more downhole isolation tools in accordance with the present disclosure. Specifically, a first downhole isolation tool 902 may be similar to that described above with respect to FIGS. 2A, 2B, 4A and 4B. The first downhole isolation tool 902, i.e., the lowermost downhole isolation tool, is configured to receive and seat the smallest ball of a series of balls to be used with downhole isolation system. Thus, in this example, the first downhole isolation tool 902 may include a ball seat mandrel 318 that includes four ball seats 324A, 324B, 324C, 324D and four corresponding throughbores (only two shown in this view) 328A, 328B, as shown and described with respect to FIGS. 4A and 4B. The four ball seats may be equally spaced about the inner perimeter of the ball seat mandrel 318 and may maximize the fluid flow area through the ball seat mandrel 318 when a ball is not seated in one or more of the ball seats 324A, 324B, 324C, 324D.

A second downhole isolation tool 904 may be run above the first downhole isolation tool 902. The second downhole isolation tool 904 is configured to allow passage of the dropped balls to the first downhole isolation tool 902 or from the first downhole isolation tool 902 to the surface during production of fluids from lower zones. Thus, the second downhole isolation tool 904 is configured to receive and seat a ball having a size (i.e., diameter) larger than the balls used to seat against the first downhole isolation tool 902. As such, in one embodiment, the second downhole isolation tool 904, as shown in FIGS. 2A and 2B, may be used having a ball seat mandrel 218 as shown in FIGS. 3A and 3B. Specifically, the second downhole isolation tool 904 may include a ball seat mandrel 218 having two ball seats 224A, 224B axially aligned with two corresponding throughbores 228A, 228B. The ball seats 224A, 224B may be equally spaced about the inner perimeter of the ball seat mandrel 318 and may maximize the fluid flow area through the ball seat mandrel 218 when a ball is not seated in one or more of the ball seats 224A, 224B. Thus, the size (i.e., diameter) of each ball seat 224A, 224B of the second downhole isolation tool 904 is larger than the size (i.e., diameter) of each ball seat 324A, 324B, 324C, 324D of the first downhole tool 902.

Figure 8B:
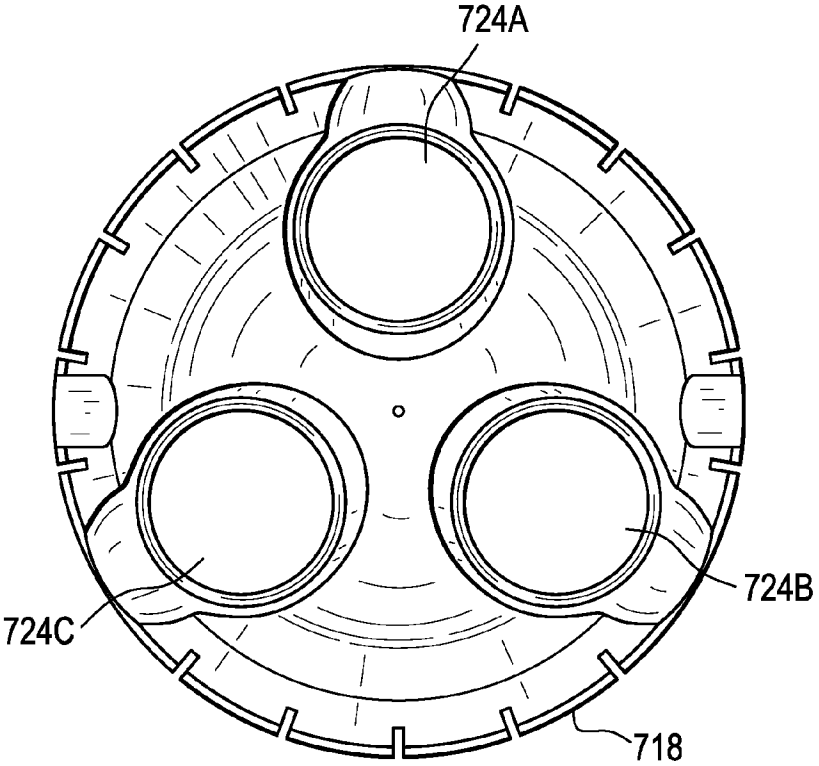
FIGS. 8A and 8B show a perspective view and a top view, respectively, of a ball seat mandrel for a downhole isolation tool in accordance with embodiments disclosed herein.
Figure 8A:
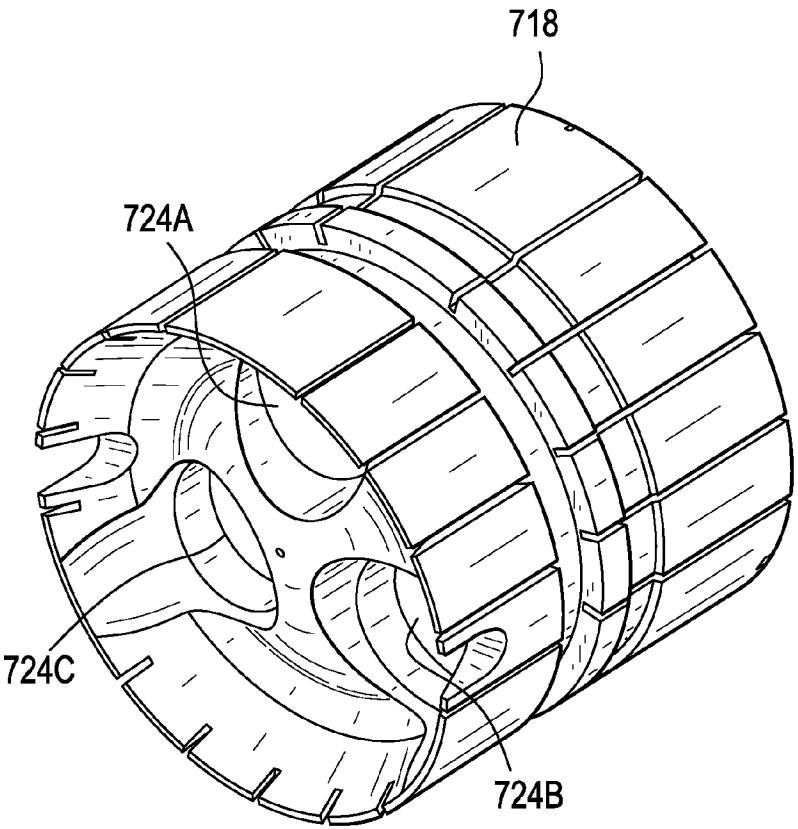

In other embodiments, additional downhole isolation tools may be run with the first and second downhole isolation tools described above, such that each lower positioned downhole isolation tool is configured to receive and seat a smaller ball than the downhole isolation tools positioned above. In one example, a third downhole isolation tool having a ball seat mandrel 718 having three ball seats 724A, 724B, 724C and three axially aligned corresponding throughbores (not shown), as shown in FIGS. 8A and 8B, may be positioned above the first downhole isolation tool and below the second downhole isolation tool. As such, each ball seat 724A, 724B, 724C of the third downhole isolation valve is larger than each ball seat 324A, 324B, 324C, 324D of the first downhole isolation tool, but smaller than each ball seat 224A, 224B of the second downhole isolation tool. While in this example, the number of ball seats decreases from the lowermost tool to the uppermost tool, one of ordinary skill in the art will appreciate that the number of ball seats of each downhole isolation tool may be the same, but the size (i.e., diameter) of the ball seats increases from the lowermost downhole tool to the uppermost downhole tool. In still other embodiments, downhole isolation tools having at least two ball seats as described herein may be run with downhole isolation tools having only one ball seat and one corresponding throughbore. In such a system, the downhole isolation tool having one ball seat may include a ball seat mandrel with a contoured upper face as described herein, and the size of the ball seat may be sized based on the axial position of the downhole isolation tool with one seat with respect to other downhole isolation tools with two or more ball seats when run in hole.

A method of running a downhole isolation system as described herein and a method of isolating a well with a downhole isolation system as described herein is now discussed. A method of isolating a well in accordance with embodiments disclosed herein includes running a downhole isolation system into a well, the downhole isolation system including a first downhole isolation tool. The first downhole isolation tool includes a first sub, a first sleeve disposed in the sub, and a first ball seat mandrel coupled to the first sleeve, the first ball seat mandrel including at least two ball seats of a first size axially aligned with at least two throughbores disposed within the first ball seat mandrel. When the zones above and below the downhole isolation tool need to be isolated, e.g., so hydraulic fracturing of the zone above the downhole isolation tool may be performed, at least two balls of a first size are dropped into the well. The balls may be placed in a fluid that is pumped down through the string into the well. When the balls reach the first downhole isolation tool, each ball moves into a ball seat of the isolation tool. The contour of the face of the ball seat mandrel, as well as the pressure of the fluid flow, help position the balls in the ball seats. Pressure from above the first downhole isolation tool, i.e., fluid pressure, against the seated balls effects a seal across the inside diameter of the downhole isolation tool, thereby isolating the zone(s) below the tool from the zone(s) above the tool. Once such seal is effected, other processes may be performed, for example, hydraulic fracturing of the formation or cased well, as discussed above.

Additional zones may be isolated in a downhole isolation system having two or more downhole isolation tools. In this embodiment, a second downhole isolation tool is run into the well above the first downhole isolation tool. The second downhole isolation tool includes a second sub, a second sleeve disposed in the sub, and a second ball seat mandrel coupled to the second sleeve. The second ball seat mandrel includes at least two ball seats of a second size axially aligned with at least two throughbores disposed within the second ball seat mandrel. When the zones above and below the second downhole isolation tool need to be isolated, e.g., so hydraulic fracturing of the zone above the downhole isolation tool may be performed, at least two balls of a second size are dropped into the well. The balls may be placed in a fluid that is pumped down through the string into the well. When the balls reach the second downhole isolation tool, each ball moves into a ball seat of the second downhole isolation tool. The contour of the face of the ball seat mandrel, as well as the pressure of the fluid flow, help position the balls in the ball seats. Pressure from above the first downhole isolation tool, i.e., fluid pressure, against the seated balls effects a seal across the inside diameter of the downhole isolation tool, thereby isolating the zone(s) below the tool from the zone(s) above the tool. Once such seal is effected, other processes may be performed, for example, hydraulic fracturing of the formation or cased well, as discussed above.

Balls of varying sizes may be used to seat in and seal different downhole isolation tools of a downhole isolation system. Balls of a first size are dropped to seat against the first downhole isolation tool. The ball of a first size are smaller than the balls of a second size, which are dropped to seat against the second downhole isolation tool positioned axially above the first downhole isolation tool. The balls of a first size are small enough to fit safely through (i.e., without plugging or sealing) the ball seats of the second downhole isolation tool, but small enough to seat against the ball seats of the first downhole isolation tool and to effect a seal. The balls of a second size are larger than the ball seats of the second downhole isolation tool, so as to seat against and seal the second downhole isolation tool.

Once the additional processes have been completed, production of lower zones may be initiated or resumed. Referring back to FIGS. 2A and 2B, production of lower zones may be initiated or resumed by removing the seal effected by the balls seated in the ball seat. To do this, a pressure differential across the ball seat mandrel 218 is applied by increasing the fluid pressure acting on the upper face 226 of the ball seat mandrel 218 having balls (not shown) seated within each ball seat (not shown). The pressure above the ball seat mandrel 218 is increased above a predetermined value that corresponds to a maximum rating of shearing device 212 that couples the sleeve 208 to the sub 202. Once the predetermined value is exceeded, the shearing device 212 is sheared, thereby allowing the sleeve 208 to move axially downward until a lower end 214 of the sleeve 208 contacts an internal shoulder 216 in the sub 202. Because the ball seat mandrel 218 is coupled to the sleeve 208, the ball seat mandrel 218 moves axially downward with the sleeve 208. The sleeve 208 moves axially downward a distance sufficient to open one or more ports 221 of the sub 202. Once the ports 221 are open, i.e., the sleeve 208 has moved downward and no longer blocks the ports 221, fluid flow from above the downhole isolation tool may flow into the annulus (not shown) formed between the outside diameter of the sub 202 and the well, casing, or other downhole tools. Production of fluids from zones below the downhole isolation tool will lift the balls seated in the ball seats and carry the balls to the surface. Because the ball seats and corresponding throughbores of higher positioned downhole isolation tools have larger diameters than the balls dropped for lower downhole isolation tools, as discussed above, the balls may be carried by a produced fluid up through other downhole isolation tools and returned to the surface.

Embodiments described herein advantageously provide downhole isolation tools having large equivalent throughbores by using multiple ball seats and multiple balls to effect a seal across each downhole isolation tool. A downhole isolation system in accordance with the present disclosure advantageously allows for multiple distinct zones to be isolated, fractured, and produced, but reduces the amount of pumping horsepower needed. Specifically, because the fluid flow area through each downhole isolation system is maximized with the use of multiple ball seats, the pressure drop across a ball seat of a downhole isolation tool in accordance with embodiments disclosed herein may be as low as 600 psi, or lower, as compared to the 1000 psi differential of conventional ball seats. Thus, a lower pumping horsepower is required to isolate the tool and shift the sleeve of the tool to open ports to the annulus. Decreasing the required pumping horsepower may advantageously reduce the over all cost of a fracturing job.

Additionally, some embodiments may advantageously provide a ball seat mandrel having a cavity disposed within a lower end of the mandrel. Such cavity may provide easier drilling of the ball seat mandrel to remove the ball seat mandrel from the well. As such, embodiments disclosed herein may provide a shorter drill time for removal of a ball seat mandrel.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A downhole isolation tool comprising:

a sub;

a ball seat mandrel disposed in the sub, the ball seat mandrel comprising:

at least two ball seats each having a corresponding throughbore disposed within the ball seat mandrel, wherein at least one of the at least two ball seats comprises a seating surface circumscribing an axis of the corresponding throughbore and being curved inwardly along the axis according to a radius of curvature that is substantially equal to a radius of curvature of a profile of a drop ball; and a convex surface through which the at least two ball seats extend, the convex surface comprising a raised central portion and a lower perimeter portion, the lower perimeter portion having a low point extending a radial distance from a peak of the convex surface to correspond with a radial distance defined by the at least two ball seats.

2. The downhole isolation tool of claim 1, further comprising a sleeve coupled to the ball seat mandrel.

3. The downhole isolation tool of claim 2, further comprising a shearing device configured to couple the sleeve to the sub.

4. The downhole isolation tool of claim 3, wherein the sub comprises an internal shoulder configured to engage the sleeve after the shearing device is sheared.

5. The downhole isolation tool of claim 1, wherein an upper face of the ball seat mandrel is contoured such that a central portion of the upper face is higher than a circumferential portion proximate each of the at least two ball seats.

6. The downhole isolation tool of claim 1, wherein the sub further comprises at least one port disposed proximate an upper end of the sub.

7. A downhole isolation system, the system comprising:
a first downhole isolation tool comprising:
a first sub;
a first sleeve disposed in the first sub; and
a first ball seat mandrel coupled to the first sleeve, the first ball seat mandrel comprising:
at least two ball seats axially aligned with at least two throughbores disposed within the first ball seat mandrel, wherein at least one of the at least two ball seats comprises a seating surface circumscribing an axis of the corresponding throughbore and being curved inwardly along the axis according to a radius of curvature of a profile of a drop ball; and
a convex surface through which the at least two ball seats extend, the convex surface comprising a raised central portion and a lower perimeter portion, the lower portion having a low point extending a radial distance from a peak of the convex surface to correspond with a radial distance defined by the at least two ball seats; and
a second downhole isolation tool comprising:
a second sub;
a second sleeve disposed in the second sub; and
a second ball seat mandrel coupled to the second sleeve, the second ball seat mandrel comprising:
at least two ball seats axially aligned with at least two throughbores disposed within the second ball seat mandrel.

8. The system of claim 7, wherein the first ball seat mandrel comprises at least three ball seats and the second ball seat mandrel comprises at least two ball seats.

9. The system of claim 7, wherein at least one of the at least two ball seats of the second ball seat mandrel comprises a seating surface having an arcuate profile with a radius of curvature that is substantially equal to a radius of curvature of a profile of a drop ball.

10. The system of claim 7, wherein a diameter of each the at least two ball seats of the first ball seat mandrel is the same.

11. The system of claim 7, wherein the diameters of each of the at least two ball seats of the first ball seat mandrel are different than the diameters of each of the at least two ball seats of the second ball seat mandrel.

12. The system of claim 7, wherein the number of ball seats of the first downhole isolation tool is equal to the number of ball seats of the second downhole isolation tool.

13. The system of claim 12, wherein a diameter of each of the ball seats of the first downhole isolation tool is different than the diameter of each of the ball seats of the second downhole isolation tool.

14. A method of isolating a well, the method comprising:
running a downhole isolation system into a well, wherein the downhole isolation system comprises a first downhole isolation tool, the first downhole isolation tool comprising:
a first sub;
a first sleeve disposed in the sub; and
a first ball seat mandrel coupled to the first sleeve, the first ball seat mandrel comprising:
at least two ball seats of a first size axially aligned with at least two throughbores disposed within the first ball seat mandrel;
dropping at least two balls of a first size into the well; and
seating the at least two balls of the first size in the at least two ball seats of the first ball seat mandrel, wherein the at least two ball seats each comprises a seating surface circumscribing an axis of the corresponding throughbore and being curved inwardly along the axis according to a radius of curvature that is substantially equal to a radius of curvature of a profile of the balls, and wherein the first ball seat mandrel comprises a surface through which the at least two ball seats extend, the convex surface comprises a raised central portion and a lower perimeter portion extends a convex surface through which the at least two ball seats extend, the convex surface comprising a raised central portion and a lower perimeter portion, the lower perimeter portion having a low point extending a radial distance from a peak of the convex surface to correspond with a radial distance defined by the at least two ball seats.

15. The method of claim 14, further comprising increasing a pressure differential across the balls and the ball seats.

16. The method of claim 14, wherein the downhole isolation system further comprises a second downhole isolation tool, the second downhole isolation tool comprising:
a second sub;
a second sleeve disposed in the sub; and
a second ball seat mandrel coupled to the second sleeve, the second ball seat mandrel comprising:
at least two ball seats of a second size axially aligned with at least two throughbores disposed within the second ball seat mandrel.

17. The method of claim 16, further comprising:
dropping at least two balls of a second size into the well; and
seating the at least two balls of the second size in the at least two ball seats of the second ball seat mandrel.

18. The method of claim 16, wherein the first downhole isolation tool is positioned axially below the second downhole isolation tool in the well, and wherein the first size of the ball seats of the first ball seat mandrel are smaller than the second size of the ball seats of the second ball seat mandrel.

19. The method of claim 14, further comprising:
increasing a pressure differential across the at least two balls seats;
shearing a shearing device; and
moving the first sleeve axially downward within the sub.

* * * * *